US006044892A

United States Patent [19]

Epstein

[11] Patent Number: 6,044,892

[45] Date of Patent: Apr. 4, 2000

[54] FRAME ASSEMBLY

[76] Inventor: Marc I Epstein, 1172 Park Ave., New York, N.Y. 10128

[21] Appl. No.: 09/175,186

[22] Filed: Oct. 20, 1998

[51] Int. Cl.[7] ..... A47G 5/00

[52] U.S. Cl. ..... 160/380; 160/104; 160/215; 49/55; 49/57; 55/491; 55/503

[58] Field of Search ..... 160/90, 104, 106, 160/179, 369, 371, 373, 377, 375, 376, 380, 40, 215; 55/490, 491, 495, 501, 503, 504; 49/57, 55, 50, 61

[56] References Cited

U.S. PATENT DOCUMENTS

| | | | |
|---|---|---|---|
| 1,056,722 | 3/1913 | Adler | 160/179 X |
| 1,409,050 | 3/1922 | Jurisch | 160/104 |
| 1,449,294 | 3/1923 | Respess | 160/104 X |
| 1,660,168 | 2/1928 | Kimball | 160/375 X |
| 2,246,580 | 6/1941 | Farmer | 160/375 X |
| 2,337,326 | 12/1943 | Hardy | 160/179 |
| 3,019,854 | 2/1962 | O'Bryant | 55/491 |
| 3,132,015 | 5/1964 | O'Bryant | 55/491 |
| 3,553,942 | 1/1971 | Harrington et al. | 160/371 X |
| 3,942,576 | 3/1976 | Rickard | 160/104 |
| 4,026,082 | 5/1977 | Crofoot | 160/104 X |
| 4,099,944 | 7/1978 | Davis | 55/503 X |
| 4,837,974 | 6/1989 | Jokel | 49/55 |
| 5,312,467 | 5/1994 | Wolfe | 55/493 |
| 5,571,300 | 11/1996 | Stemmer | 55/495 X |

*Primary Examiner*—David M. Purol
*Attorney, Agent, or Firm*—William E. Pelton, Esq.

[57] ABSTRACT

A frame assembly is adjustable to fit within a range of desired openings and includes juxtaposed first and second frame units detachably assembled together. An intervening media material is releasably sandwiched between the frame units. The media material defines a slotted perimeter flap that protrudes outwardly beyond at least one outside peripheral edge of the frame units to engage and to seal a space between a perimeter defining the desired opening and the frame assembly. The frame units are detachably engaged by a mounting assembly adapted to secure the frame units over the desired opening.

12 Claims, 8 Drawing Sheets

FRAME ASSEMBLY

BACKGROUND OF THE INVENTION

1. Field of the Invention

The present invention relates to a frame assembly and, more particularly, to an adjustable frame assembly for a disposable filtering medium, such as an air filter or insect screen, that may be adapted to cover a desired window opening defined by a double hung or casement window or the like, and to remain in place independently of the position of a window sash.

2. Description of The Related Art

Adjustable frame assemblies for window air filter and especially insect screen media are popular products particularly in high rise residential and commercial buildings not usually fitted with custom screens or combination storm windows. Most prior assemblies, such as the one described in U.S. Pat. 5,312,467, are laterally adjustable frames made of wood and/or metal, attached in a cooperable, sliding engagement that is laterally adjusted to fit most double-hung windows. They are window-mounted by placing the frame assembly's bottom and side edges into the respective bottom and side channels for the lower window sash. The assembly is then held in place by lowering the sash until its bottom edge rests on the assembly's top edge.

Such prior devices also include a permanently installed filtering medium, without having a mechanism for removing used and installing new media. Such prior types of frame assemblies suffer from other significant disadvantages, including sash-mounting. Sash-mounting precludes an efficient and effective means of varying the active air-exchange area of the media without first removing the assembly and placing it inside or outside the sash. In addition, no matter what its placement, but particularly without the sash-mounting, the prior types of filter assemblies have not been firmly secured in place and a tendency to disassociate from its placement with time has heretofore been apparent.

The permanently installed filter media loses efficiency over time due to clogging, corrosion and even washing or vacuuming. However, timely replacement of used media is discouraged by the substantial added cost of having also to replace a fully functioning frame. Finally, the prior cooperable sliding section construction has been known heretofore to add undesirable cost to both the overall manufacturing and commercializing process.

These disadvantages have significantly inhibited the use of adjustable frame assemblies despite their important benefits. It has been found that adjustable frames with filter media provide the most effective, economical, non-mechanical means of reducing indoor air pollution by ventilating with outdoor air that is less likely to harm indoor environment and property with outdoor contaminants such as dirt, dust and pollen.

According to the U.S. Environment Protection Agency's Apr. 1, 1995 "Guide to Indoor Air Quality", (EPA 402-K-93-007, p. 4); "A growing body of scientific evidence has indicated that the air within homes and other buildings can be more seriously polluted than the outdoor air in even the largest and most industrialized cities". On May 26, 1989, Director of the National Institute for Occupational Safety and Health Centers for Disease Control, J. Donald Miller, testified before a U.S. Senate committee, that "As mentioned above, in over half of our indoor air quality investigations, inadequate ventilation was found to be the cause of complaints." The E.P.A.'s August 1989 Report to Congress on Indoor Air Quality, (Vol. 1, EPA 400-1-89-0011, p. 6), adds the following important perspective:

"There was wide agreement among participants at the policy forum that altering ventilation standards and practices should be central to the strategy for controlling and preventing indoor air pollution. Consideration of health should become at least equal, and perhaps paramount, to energy conservation in setting ventilation standards. Ventilation standards could become an effective means of controlling multiple pollutants simultaneously as well as cost effectively."

Public awareness of the seriousness of indoor air pollution problems and the value of ventilation has been heightened by mass media articles, such as the Dec. 1, 1996 N.Y. Times story, "The House Can Make You Sick", that concluded; "Finally, experts say it pays to keep some fresh air coming into the house from somewhere—even if it costs a few dollars more for heating fuel". Public awareness notwithstanding, most people, and especially city dwellers, prefer sealed windows and stale, polluted air to open windows with accompanying dirt, grime "pigeon-pollution" and pollen. Some spend precious energy to simulate fresh air with closed air conditioners that merely recirculate indoor air. And some use screens as inadequate filter proxies.

The typical window screen is useful for keeping many insects and small animals out, but it is not particularly useful for filtering out contaminants. These contaminants include airborne allergens such as pollen, and other airborne pollutants including soot, dust or dirt that may enter the house or apartment from the outside. The troublesome contaminant particles are often thrown into the air by industrial plants and vehicles. Ailments that can be caused, aggravated or triggered by such contaminants include allergic reactions, asthma, etc. As indicated above, at least some elementary testing of air quality is now often recommended and included in house inspections and the sale of expensive and cumbersome air purification systems has grown tremendously.

Various types of frames for holding air filters and window screens have been known heretofore. The filters or screens are typically mounted to a frame which is pre-sized at least in one direction to fit into a particular opening whether it be in an air conditioner unit or other unit requiring air filtering. The filter or screen frames known heretofore have been adjustable in the lateral direction only so as to fit different window widths. However, this type of frame is actually limited to only one fixed air exchange area since the height dimension is fixed and the frame depends upon engagement with the sash along its top to be held in place.

What has been needed heretofore is an adjustable filtering or screening mechanism having a frame assembly and filter media structure which may be configured to the desired air exchange area independently of the area of the frame assembly itself, in contrast to the known mechanism in which the desired opening is entirely and permanently determined by the size of the frame assembly.

SUMMARY OF THE INVENTION

The foregoing and other disadvantages of the prior type of adjustable frame assemblies for window air filter and screen media are eliminated by the present invention in which an adjustable assembly is securely attached to a window frame while also providing a convenient means of varying the air exchange rate and an economical, simple means of replacing worn or used filtering media with clean media whenever necessary.

In one embodiment, an adjustable assembly is described combining one or more congruent frame members on the side(s) of a disposable and replaceable filtering media that is intersected by a series of loops. Adjustable rods pass through the protruding part of the loops both to clamp the media to one or a plurality of frame members and to securely attach the frame assembly to a window frame independently of the position of the window sash. The window sash remains free for vertical movement to vary or close the air exchange area of the media and the resultant air exchange rate at which outdoor air replaces indoor air.

The frame assembly in one embodiment includes first and second frame units detachably assembled together. An intervening membrane or media material is held between the frame units and extends at least to the periphery of the frame. A mounting assembly is connected to the frame for securing the frame and media material in position over the desired opening. The media material may extend beyond the peripheral edges of the frame unit effectively filling and sealing a space between the frame assembly and the perimeter of the desired opening.

The first frame unit may include a plurality of loop members extending therefrom. The second frame unit may include a plurality of orifices each of which corresponds to one of the plurality of loop members extending from the first frame unit. The plurality of loop members extend through the plurality of orifices when the first and second frame units are assembled together. The mounting assembly may include at least one rod which passes through various loop members when the first and second frame units are assembled together for maintaining the first and second frame units together and for mounting the frame assembly within an opening.

The present invention is more economical and efficient than the prior types of filtering assembly and may be adapted to be used with custom fit screens, window fans and the like.

BRIEF DESCRIPTION OF THE DRAWINGS

The accompanying drawings which are incorporated into and constitute a part of this specification, illustrate preferred embodiments of the present invention and together with a general description of the invention given above and the detailed description of the preferred embodiments given below serve to explain the principles of the invention.

DETAILED DESCRIPTION OF THE PREFERRED EMBODIMENTS

Figure 1A:
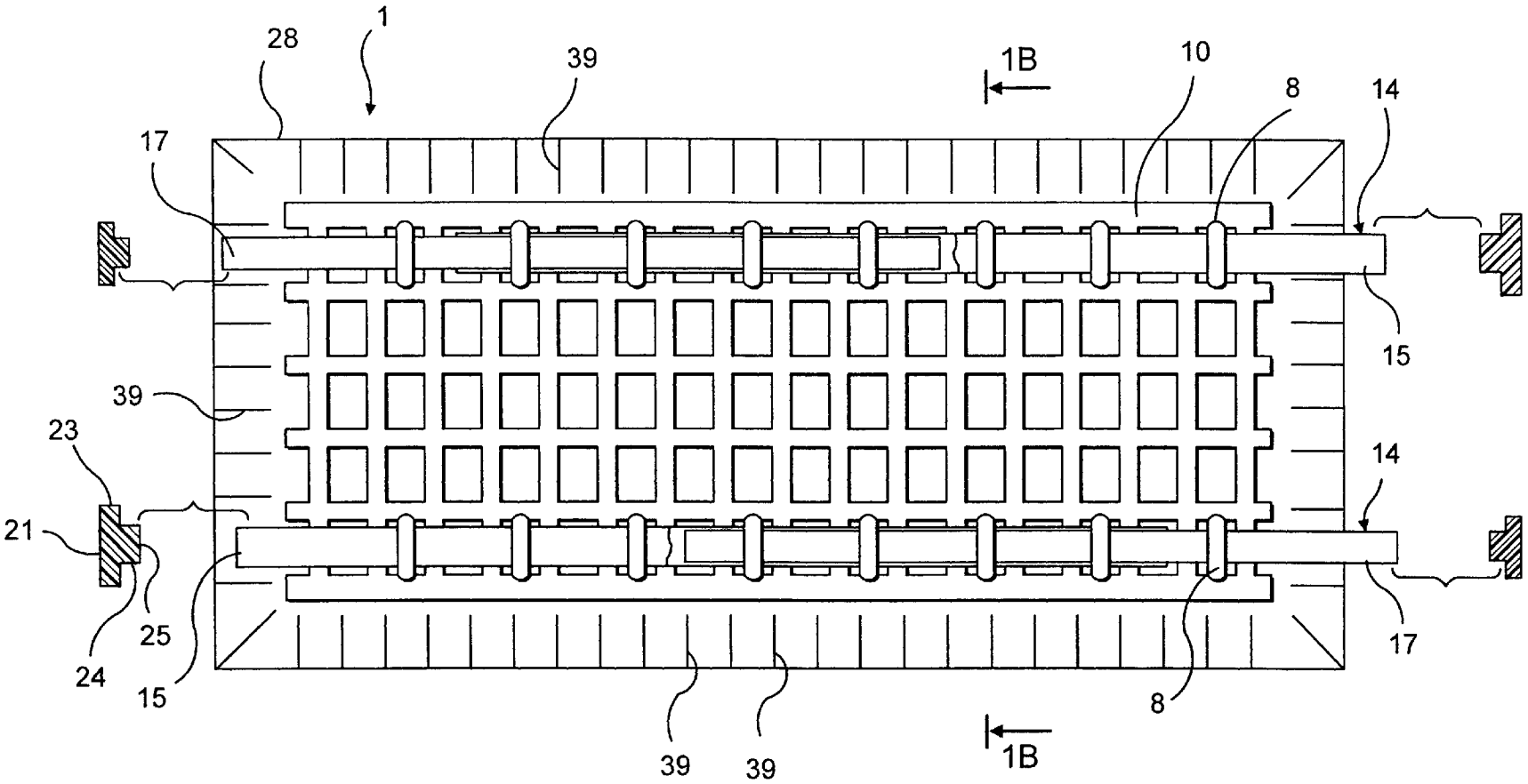
FIG. 1A is a front perspective view of a frame assembly according to one embodiment of the present invention.

A frame assembly according to one embodiment of the present invention is described by reference to FIGS. 1A–1C and 2A–2B, and is generally indicated by the reference numeral 1. Frame assembly 1 is formed essentially of one or more compact rectangular latticework frame sections of the type shown in FIGS. 2A and 2B, respectively, by reference characters 10 and 12. The frames may be configured in a lattice or other pattern for rigidity, support, cuttability and air exchange. They are preferably of uniform thickness and are light-weight. Frame sections 10 and 12 preferably are formed of a semi-rigid material which is rust-proof, warp-proof and UV resistant. They may be constructed from molded plastic or stamped aluminum, waterproof semi-rigid rubber, or the like and therefore are susceptible of being cut-to-fit as to height and width with common household shears/scissors. They may be about 48 inches wide, a dimension sufficient to cover or fit an estimated 95% of all double-hung windows. They may vary in height from 6 inches and up, with the preferred height being about 10 inches.

Figure 1C:
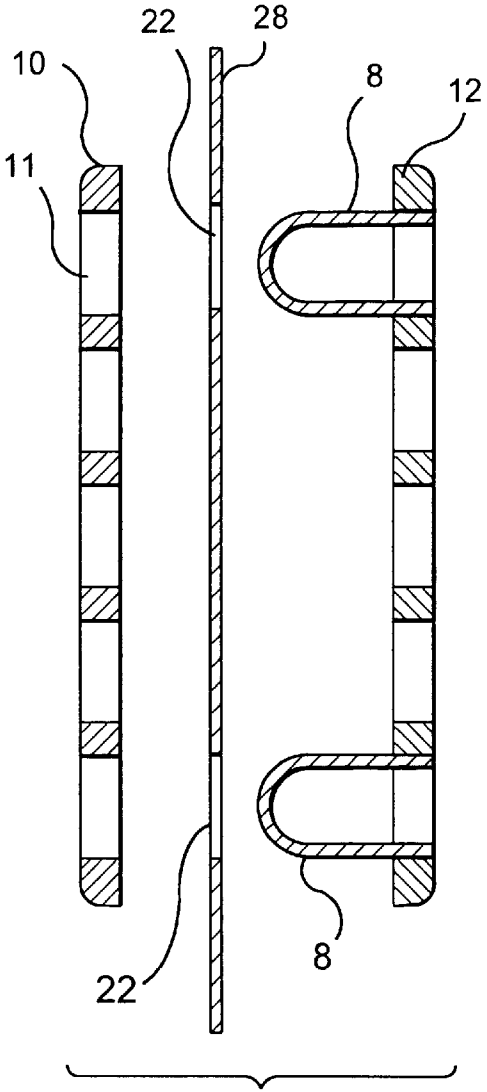
FIG. 1C is an exploded cross-sectional view of the frame assembly depicted in FIG. 1B.

In this embodiment frame section 12 includes a plurality of loops 8 which extend laterally outwardly at substantially right angles to the plane of the section, as shown more clearly in FIG. 1C. Loops 8 are formed integral with or are fused or otherwise secured to the outside of the inside frame section 12 along its top and bottom edges. The loops 8 are preferably formed so as to define a pair of spaced apart parallel rows. In one embodiment the loops are spaced approximately ½ to 1 inch apart and each of the pairs of rows is located approximately 1 inch from its respective top and bottom edge of the inside frame section 12. It will be understood that the number of such loops may vary as desired, it being found that a minimum of two is needed for best results in the present embodiment. As will become apparent from the description below, the more loops provided the more versatile the frame assembly will be. For example, with multiple lateral loops and/or multiple rows of loops the frame supporting the filter medium may be cut to alter the width and/or height of the frame assembly without affecting its efficacy. Frame section 10 includes orifices or notches 11 formed by the latticework material at positions substantially corresponding to the positions of loops 8 extending from section 12.

With reference to FIG. 1C, where two frame sections are used, frame sections 10 and 12 are placed side by side, with media material 28 located therebetween. The media material may be a screening or filtering material, as more fully described below, having a uniform thickness of about one to two 32nds of an inch. Media material 28 preferably has perforations or slits 22 formed therein at appropriate positions to allow loops 8 to extend easily through the material. Frame sections 10 and 12 are then brought together so that loops 8 extend through the slits 22 in the media material 28 and through the orifices or notched portions 11 of frame section 10 and beyond the outside surface of frame section 10, as shown in FIG. 1B. When the frame members are assembled, the media material 28 is located between them. The outside frame member 10 is positioned by means of the same loops which, as indicated, are long enough to pass through corresponding openings in the outside frame member while registering with the perforations in the medium when the parts are in proper relation. Thus no particular care is required in arranging the parts when assembling them.

Figure 1D:
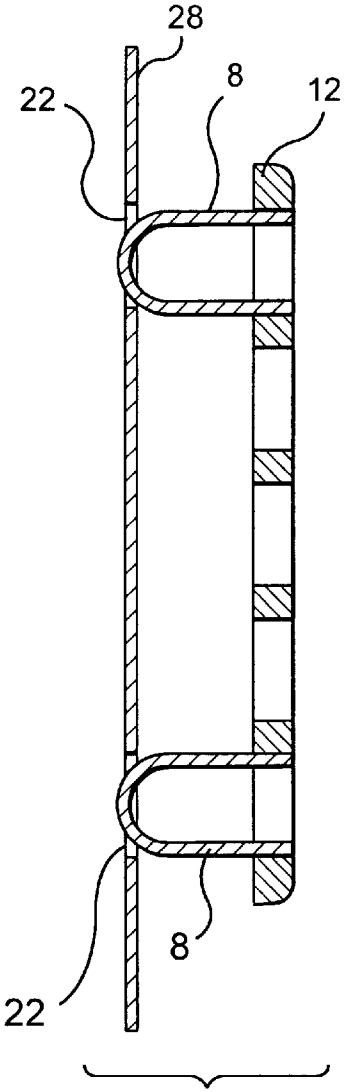
FIG. 1D is an exploded cross-sectional view of another embodiment of the present invention in which only a single frame section is utilized.
Figure 1B:
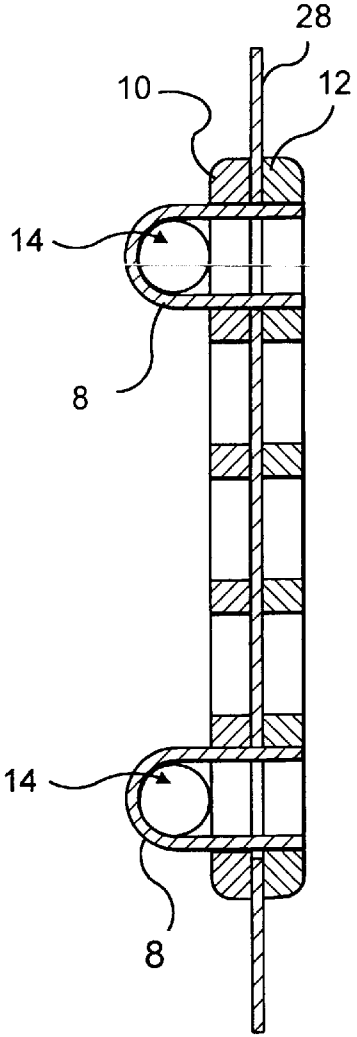
FIG. 1B is a cross-sectional view of the frame assembly shown in FIG. 1A taken along the lines 1B—1B and showing in broken lines the frame assembly in a transversely curved configuration.
Figure 2A:
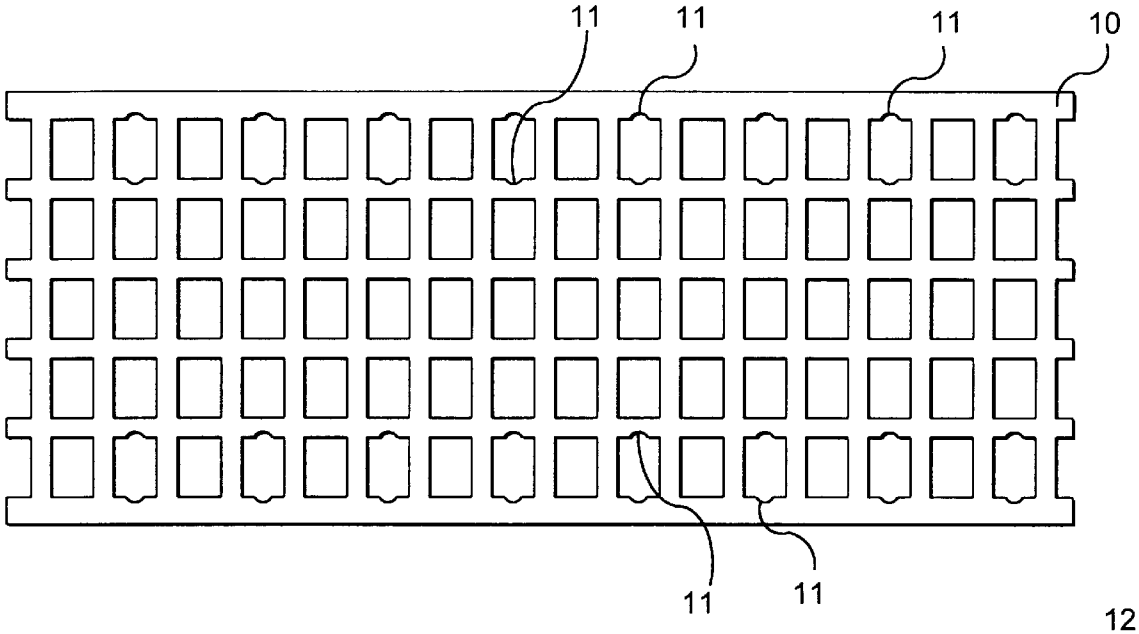
FIGS. 2A and 2B are views of two latticework sections of material used to form the frame assembly shown in FIG. 1A and showing a plurality of mounting loops and orifices.
Figure 2B:
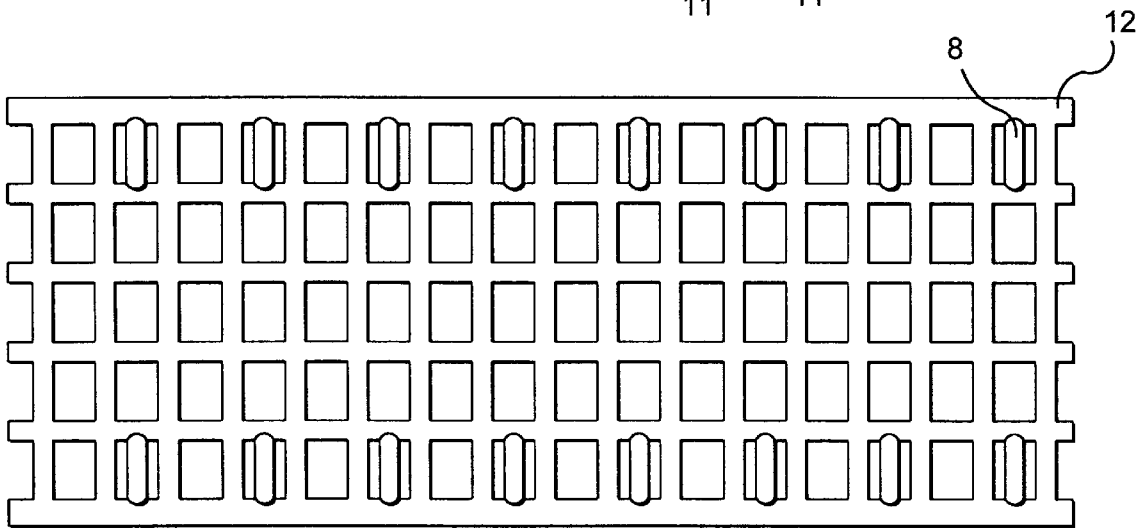

With reference to FIG. 1D, where one frame section is used, the media material 28 is placed against the single frame 12. The loops 8 extend from the frame 12 and through the slits 22 of the filtering media as described herein, thereby to locate the filtering media in proper position.

In both the embodiments of FIGS. 1C and 1D, the assembly is secured together by inserting at least one, and preferably a plurality, of longitudinally adjustable rods 14 through the protruding loops 8, as may be seen from FIGS. 1A and 1B. Loops 8 should have an appropriate radius and rods 14 should have an appropriate diameter so that rods 14 can be relatively easily slid through loops 8 while still providing sufficient pressure to firmly hold the assembly together. In the embodiment as shown in FIG. 1B, the rods 14 thus pass through loops 8 of the assembled frame 1 and "lock" the media material 28 in place between frame sections 10 and 12. For some installations, more than two such rods 14 may be used without departing from the scope of the invention.

Although rods 14 can each be formed of predetermined lengths of tubing material and can be made so as to be cut-to-fit to any desired window opening, they are preferably adjustable, each formed from two lengths of tubing sections, as shown in FIG. 1A. A first section 17 is slightly smaller in diameter than second section 15, so that the smaller diameter section 17 can be inserted into the larger diameter section 15 to form a telescoping rod, as shown. Rods 14 can also be spring loaded, including a spring member (not shown) for urging first and second sections 17 and 15 in opposite directions, or releasably interconnected by means of a suitable detent mechanism. In the alternative, rods 14 can be of the screw adjustable type configured so that one section can be screwed into the other section whereby the overall length of rod 14 can be varied as desired by turning the sections relative to each other.

If rods 14 are of the tension mounted type, for example spring loaded or screw adjustable, they can include hard rubber caps over the ends thereof. The rubber caps frictionally engage corresponding perimeter portions defining the opening. The completed frame assembly 1 can then be mounted and retained within a window frame, for example, as a result of the tension created by the spring or screw adjustable rods, without requiring the use of additional mounting hardware. As indicated non-expandable cut-to-fit rods may be used with appropriate mounting brackets, as desired.

As depicted in FIG. 1A, regardless of whether the rods 14 are telescoping or one piece, frame mounts 21 can be used to assist in securing the assembly within a window. Frame mounts 21 are formed of plastic, for example, and include a mounting back 23 integrally formed with a mounting socket 24 having a circular open end 25. Socket 24 and circular open end 25 are dimensioned to receive the ends of rods 14. Mounting back 23 can be provided with double sided tape or another type of adhesive applied thereto, so that the frame mounts 21 will adhere to the window frame at appropriate positions. In the alternative, the frame mounts 21 can have one or more holes therein (not shown) for securing the frame mounts 21 to a window frame using screws, nails, etc. The ends of the rods 14 are then inserted into frame mounts 21 which are mounted to the window frame at the proper positions. Rods 14 thus hold the two frame sections 10, 12 together with media material 28 disposed therebetween and also provide an easy and efficient way for the frame assembly 1 to be mounted in a window frame. The present invention is preferably mounted outside the lower window sash but can be mounted inside.

In accordance with one aspect of the invention, the latticework frame sections 10 and 12 are each formed from a sheet of pliable, relatively soft plastic material, the thickness of which is selected to enable the plastic to be easily cut to any desired size with a pair of common household shears or scissors. In this way the dimensions of the frame assembly may be readily adapted to any desired size. Such trimming to size may be done before or after assembly of the frame sections and media material, as desired. Because there are few parts, simple in character and readily assembled and installed or removed, the installation and removal may be accomplished from inside the building.

In the several constructions illustrated herein, the adjacent surfaces of the filtering medium and supporting one or more frame members conform substantially in area and contour. For the purpose of an adjustment of the filtering medium toward and from the edges of both members of the frame, these conforming surfaces of the frame members may be somewhat curved transversely toward the window sash and the bottom edges of the window frame.

In order that there are minimal uncovered gaps between the four edges of the assembly and the corresponding edges of the window frame and window sash, the filtering medium may be sized approximately two inches wider and higher than the frame assembly to extend approximately one inch beyond all four sides of the frame when centered in the assembly. It thereby becomes virtually leakproof and as air-tight as physically possible.

Figure 3B:
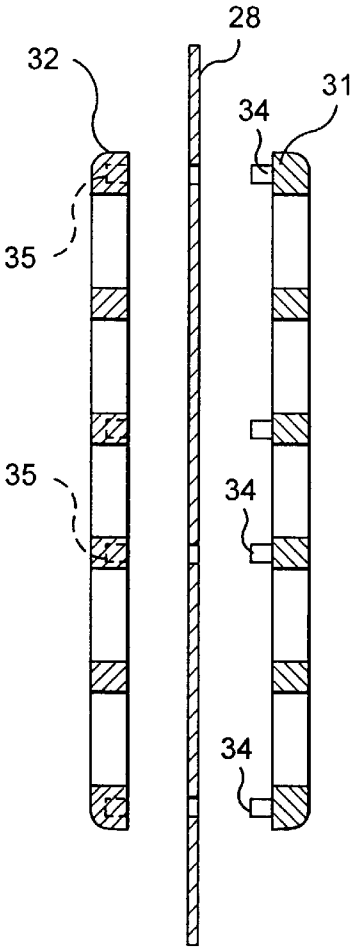
FIG. 3B is an exploded cross-sectional view of the frame assembly shown in FIG. 3A taken along the lines 3B—3B.
Figure 3A:
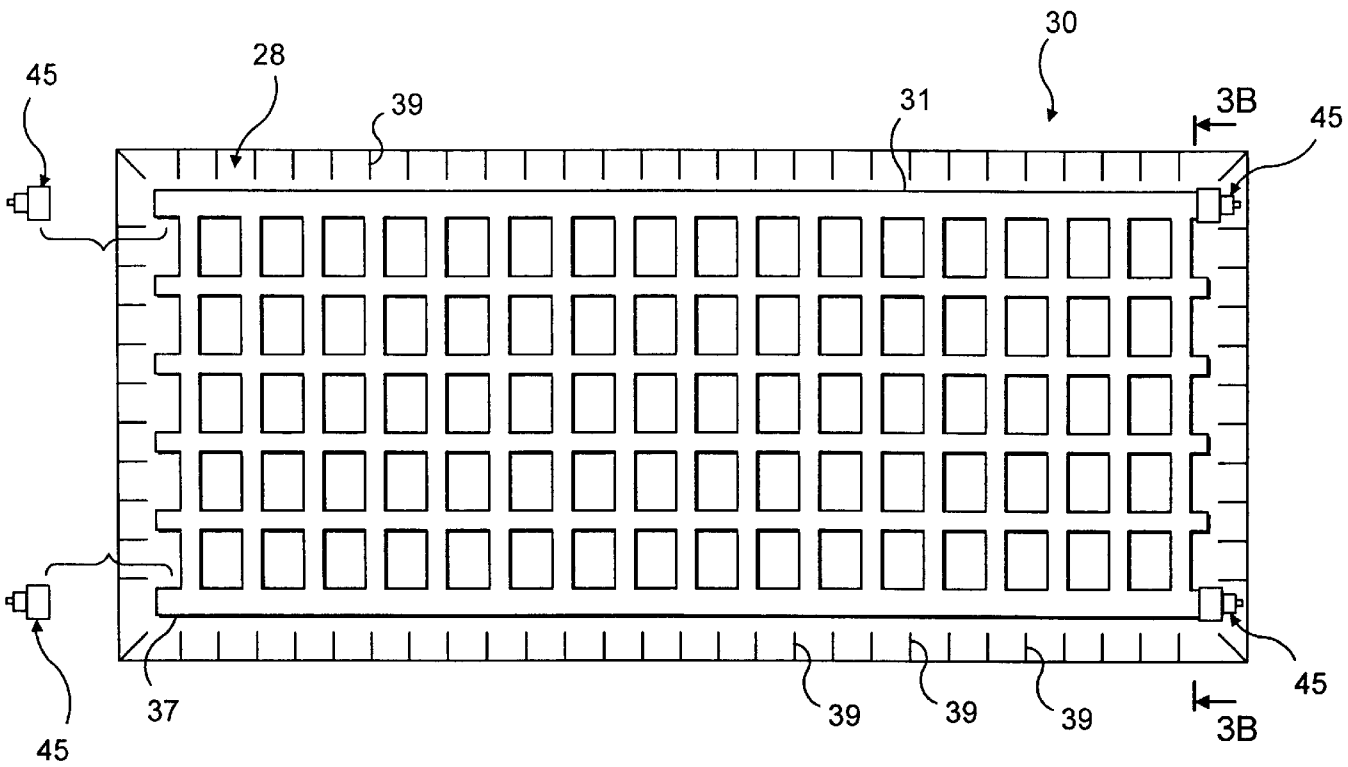
FIG. 3A is a front view perspective view of a frame assembly according to another embodiment of the present invention.
Figure 4A:
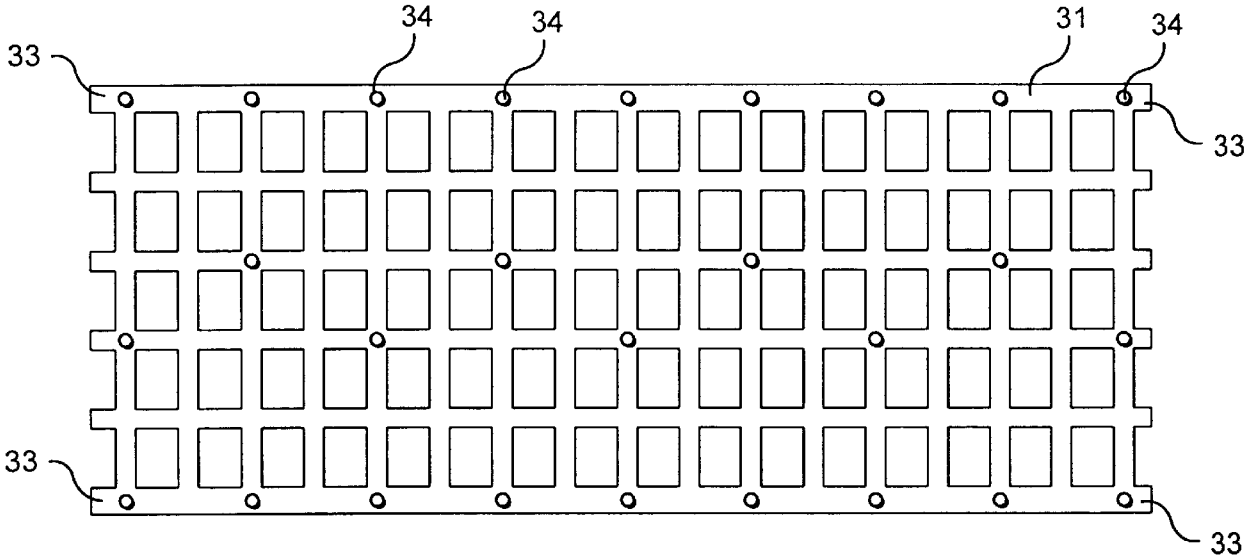
FIGS. 4A and 4B are views of two latticework sections of material used to form the frame assembly shown in FIGS. 3A.
Figure 4B:
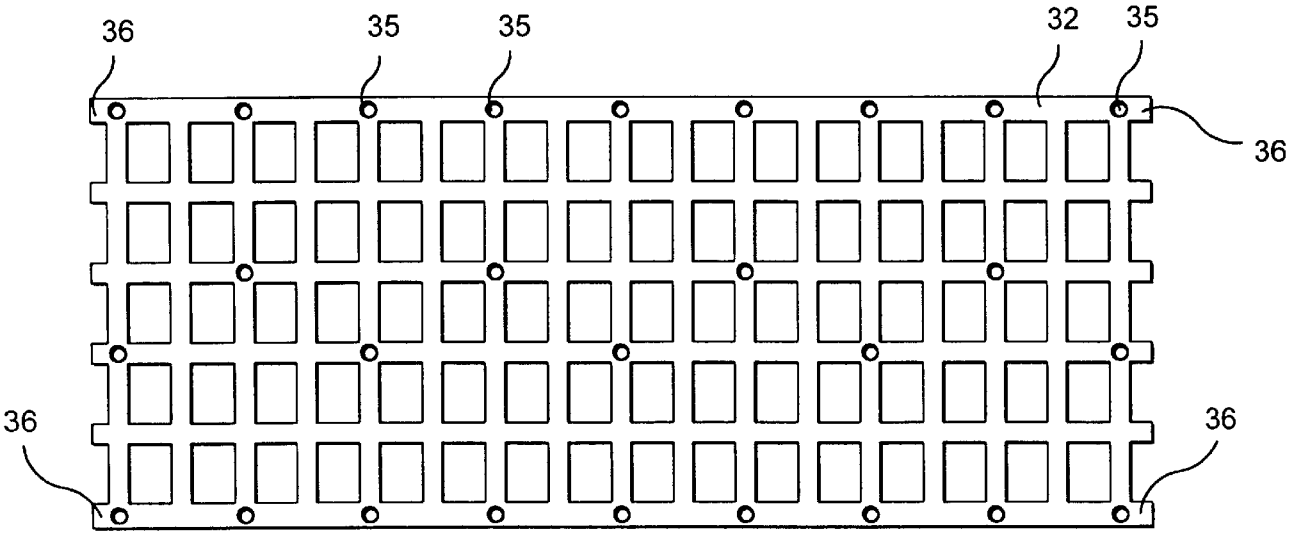

A frame assembly according to another embodiment of the present invention is described by reference to FIGS. 3A, 3B, 4A and 4B. The frame assembly according to this embodiment of the present invention is referred to generally as frame 30. Frame 30 is formed essentially of two rectangular latticework sections 31 and 32, as shown in FIGS. 4A and 4B, respectively. With reference to FIG. 3B, frame section 31 includes pins 34 extending therefrom at various points along the latticework. Frame section 32 includes holes 35, positioned to receive pins 34 when the sections 31 and 32 are assembled together. Pins 34 and holes 35 are dimensioned and shaped appropriately to snap snugly together and to hold the frame together as a unit when frame sections 31 and 32 are pressed together. A section of media material 28 is provided between frame sections 31 and 32, as shown in FIGS. 3A and 3B. The structure of this embodiment may be adjusted to establish a desired air exchange area, as in other embodiments described herein.

For some installations, where adjustability is not required or desirable, the frame sections 31 and 32 can be designed and manufactured to include protruding corner posts 33 and 36, as shown in FIGS. 4A and 4B, respectively, which may be used to mount the completed frame assembly in position within a window frame. In such an embodiment of the present invention, for example, adjustable rods may not be necessary where the assembled frame 30 is properly dimensioned to fit relatively tightly within a window frame. In that event rubber caps or the like (not shown) can be inserted over the corner posts to aid in retaining the frame 30 within the window frame.

Other suitable techniques may be used to retain the frame assembly in position without departing from the scope of the invention. For example, frame mounts 21, as described above with respect to FIG. 1, may also be utilized. In the alternative, mounting caps 45 having a pointed projection to penetrate the window frame when the frame assembly is installed thereby to hold the frame in position, may be used where appropriate.

The media material 28 located between the juxtaposed frame sections as described above can be a flexible and rust-proof screen material such as fiberglass for protection against insects and the like, or a non-electrical non-mechanical preferably electrostatic filtering material capable of filtering impurities in the air. For purposes of air filtering, the media material may be 3M Filtrete™ electrostatic filter material, although the present invention is not to be limited by the type or purpose of the media material. Filtrete™ is a trademark of the 3M Corporation.

As described in the above embodiments, media material 28 is sized to correspond to the overall frame dimensions so as to cover all of the orifices formed by the latticework frame sections. In addition, as shown in FIGS. 1A and 3A, the media material preferably projects beyond the outside perimeter of the frame assembly by a selected amount, which in typical usage may be approximately one inch, to define a perimeter flap of media material 28 that preferably surrounds the frame assembly. It should be noted however that the present invention is not to be limited by the degree to which the media protrudes beyond the edges of the frame sections. The frame members and/or media may be printed or preferably embossed with dimension markings, e.g. vertical lines, at standard intervals (e.g. 1 inch or 1 millimeter) to assist and enhance accurate measurement and cutting, especially when length for more than one use is in roll format, described below.

The top perimeter flap or fringe of media material 28 defined by the protruding media material preferably includes a plurality of spaced apart slits or notches 39 extending radially inwardly toward the edges of the frame sections from each peripheral edge of the media material. In the preferred embodiment, the slits are spaced apart approximately 1 inch, although this spacing may be varied without departing from the scope of the invention. The notches 39 along the top perimeter of the media material 28 tend to ride along the adjacent window sash and thereby accommodate and fill or minimize gaps caused by the unevenness of the window pane and window frame exterior. The perimeter fringe of media material 28 may extend completely around the perimeter of the frame assembly, as shown, or be limited to the top portion of the assembly, as desired.

Figure 6:
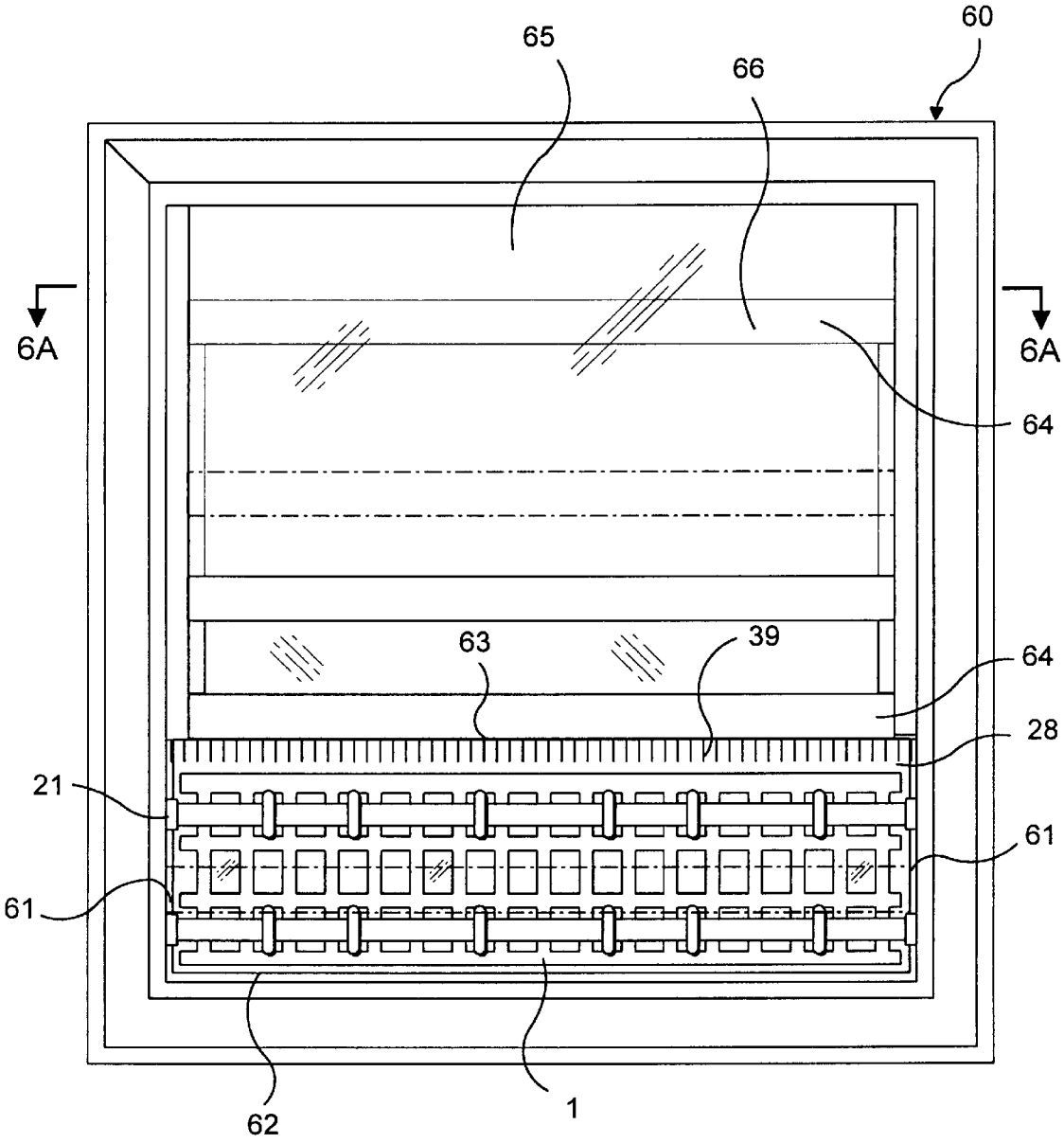
FIG. 6 is a view of a double-hung window frame from the outside looking in showing a media frame assembly according to an embodiment of the present invention mounted to the outside of the lower window sash and showing in broken lines the lower window sash in a position below the top of the media frame assembly.
Figure 6A:
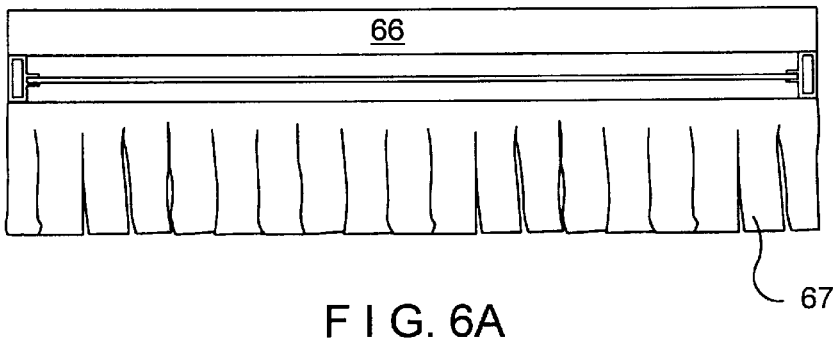
FIG. 6A is a top cross-sectional view of the window sash taken along the line 6A—6A of the embodiment shown in FIG. 6.
Figure 6B:
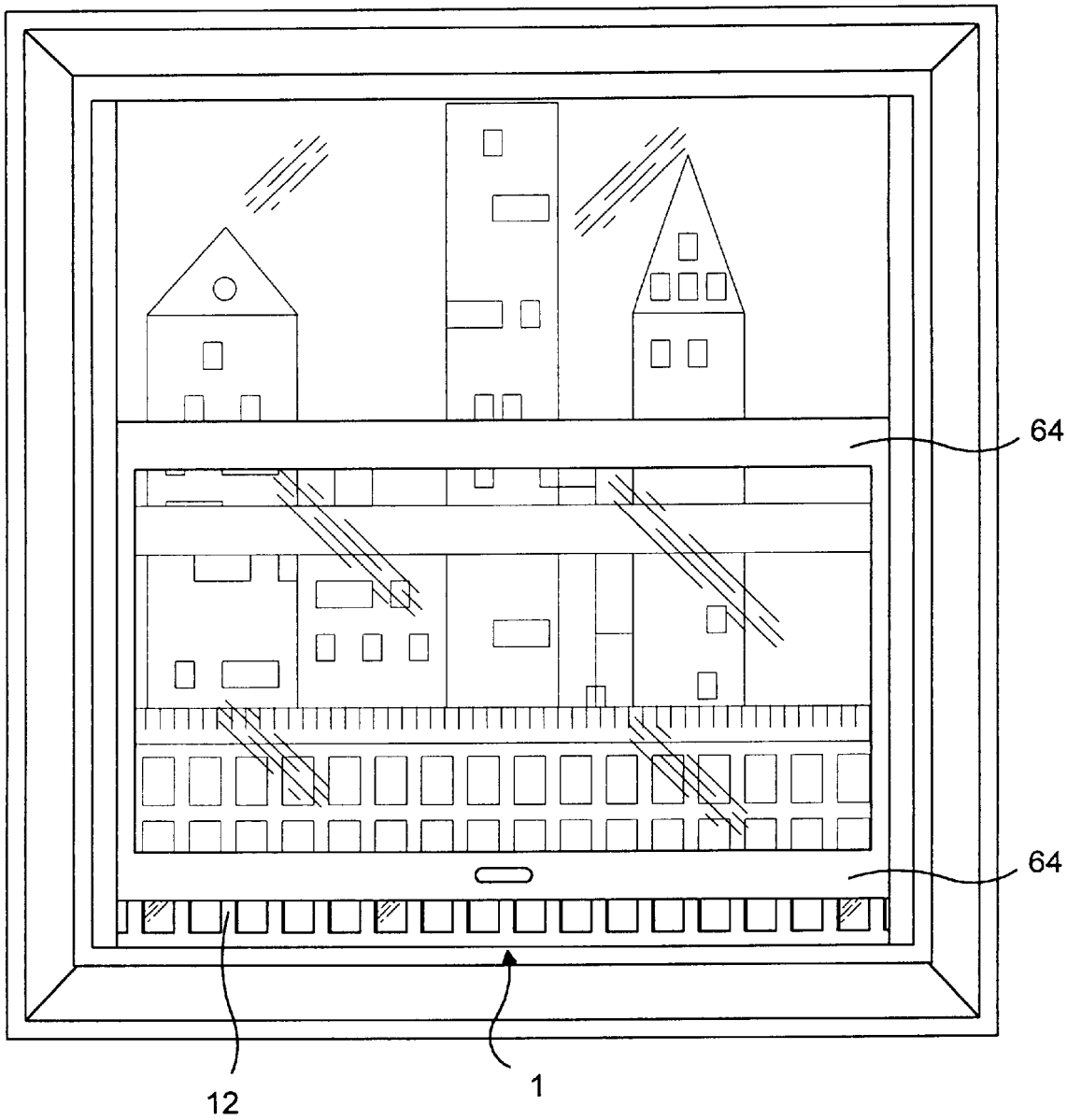
FIG. 6B is a view of the double-hung window frame and media frame assembly of FIG. 6 shown from the inside looking out.

With reference to FIG. 6 the frame assembly of the present invention is shown from the outside looking in mounted in place over a typical double-hung window opening. In the preferred embodiment, the media frame assembly is mounted to the outside of a typical double hung window sash, although in some circumstances may be mounted on the inside of the window sash. This allows the window sash to be moved up or down to define the window opening or air exchange area without the need to adjust or change the frame assembly holding the screening or filtering media. With reference to FIG. 6B, the media frame assembly 1 is shown from the inside looking out. The window sash and frame 64 may be lowered to a position below the top of the inner frame section 12, as shown in FIG. 6B and in broken lines in FIG. 6, thereby to define an air exchange area somewhat smaller than the total area of the media frame assembly. Thus, in accordance with the present invention, the size of the desired filtered window opening or air exchange area is, for all practical purposes, independent of the size of the covering frame assembly.

When the frame assembly 1 is mounted over a window opening 60, the perimeter flap of media material 28 serves to seal off any gaps that may exist between the frame assembly and the perimeter of the opening, for example, defined in part by the outside bottom of a lower open window sash. To facilitate such a seal, the frame assembly may be bowed somewhat on installation so that its upper and lower edges protrude inwardly toward the window sash. This permits the perimeter flap of media material 28 to engage the window sash and to remain in engagement therewith irrespective of the degree to which the window is open. Such an arrangement minimizes gaps for air or wind or rain to enter between the frame assembly and the window opening perimeter. For example, such a perimeter flap on all sides of the frame assembly will seal gaps between the frame assembly 1 and interior portion 61 of the window frame 60; between the frame assembly 1 and the bottom sill 62 of the window frame 60; between the top of the frame assembly 1 and the facing side 63 of the lower sash 64; or between the frame assembly 1 and the pane(s) of window glass 65 in the movable window sash. In order for the perimeter flap of media material 28 to conform easily to the window frame, it should comprise a flexible, pliant material capable of engaging and wiping the window sash or window panes as the sash is moved without damage to the material or to the window.

Where the media material consists of a less pliant screen, it may be desirable to seal the peripheral gaps between the frame assembly and opening perimeter with strips of soft, pliable and impermeable material. Such strips of material can be glued, taped or otherwise mounted to the frame assembly edges or around the window frame, sash and sill.

As set forth in connection with the embodiments described above, the frame assemblies 1, 30 are preferably rectangular in shape so as to be adaptable to fit a typical double-hung window opening. In such circumstances, the height of the frame assembly is not critical so long as it is high enough to enable the lower window sash 64 to be raised to define the desired window opening. The width of frame assembly should span the window opening and allow the perimeter flap of media material 28 to seal the space not covered by the filter frame itself. A particular advantage of the present invention is that a sheet of latticework defining each frame section may be cut to custom fit the width of any desired window opening. The media material may also be cut to custom fit or cover the desired opening.

It will be understood by those having ordinary skill in the relevant art that the frame assemblies 1, 30 can be formed of any of a number of materials including plastic or rubber, aluminum for example, that can be cut-to-fit using common household shears or scissors. As mentioned above, this allows the frame assembly to be sold in predefined sheet sizes, for example 12 inches by 48 inches that can be cut-to-fit over the usual window opening used for ventilation by the end user. It should also be understood that while the invention has been described in connection with a ventilation opening defined by the lower sash of a double hung window, the frame assembly described herein may also be adapted to cover an opening defined by the upper sash. The frame assembly of the present invention may also be adapted to fit certain types of casement style windows, as desired.

Figure 5A:
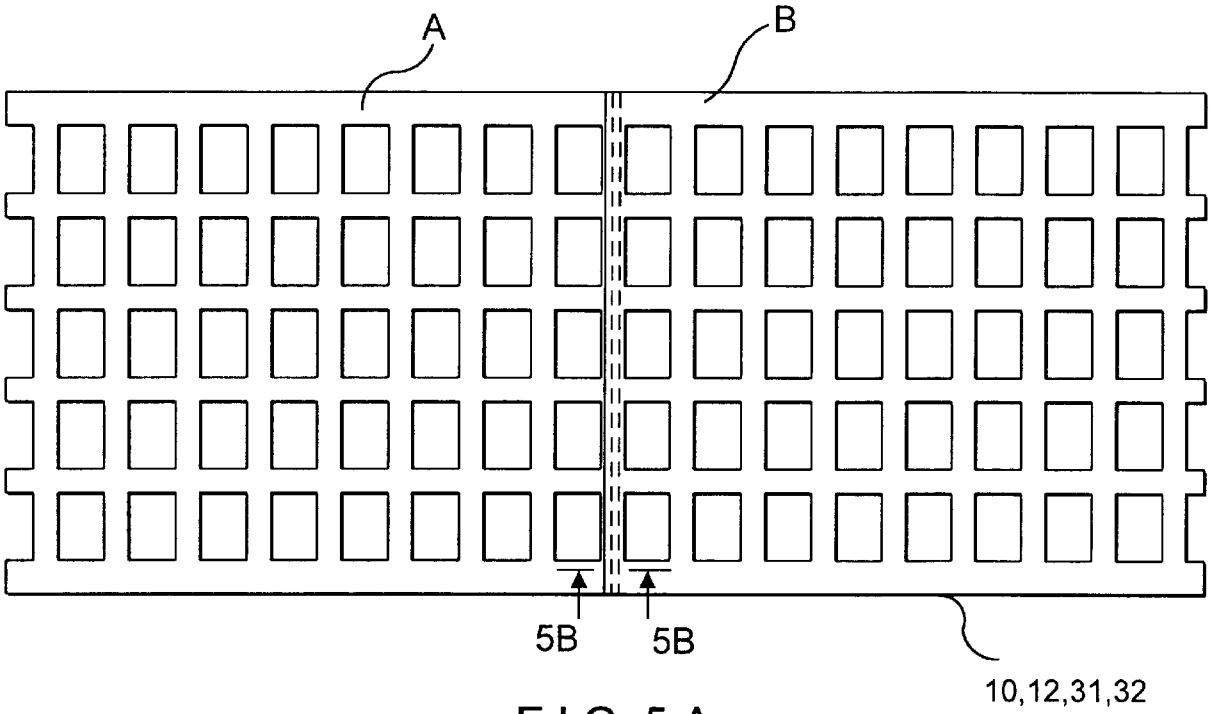
FIG. 5A is a view of frame sections including snap lock edges for locking multiple frame sections together.
Figure 5B:
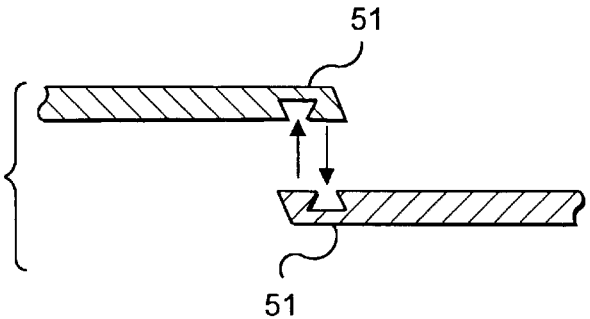
FIG. 5B is an enlarged cross-sectional view of the frame sections shown in FIG. 5A, taken along lines 5B—5B, showing the snap lock edges in more detail.

According to another embodiment of the present invention, as shown in FIGS. 5A and 5B, each frame section 10, 12, 31, 32 can be formed of two or more sections A, B of latticework material that lock together along their edges. This arrangement may be desirable to create interlocked frame sections to meet a non-standard or extra large window width or to save package facing at the point of purchase by marketing the frame in smaller interconnecting units. For such a purpose, each frame section A, B may include interlocking edges, as shown at 51. This allows smaller frame sections to be packaged together and snap assembled by the end user to define the overall frame assembly.

It will be seen that in each of the foregoing constructions as illustrated, including after separating the ("halves") or two members of the frame, the filtering medium can be conveniently grasped for insertion or removal. After removal, the single frame or both ("halves") members of the frame may be cleaned with utmost facility.

The present invention thus provides an aesthetically pleasing, convenient, economical and adjustable device for installing and securing an easily replaceable air filter medium or screen over a ventilation opening defined by either sash of most double-hung window frames without impeding the raising or lowering of the sash. In one embodiment the frame is constructed of attractive smooth plastic or metal without the spine of prior types of filtering assemblies. It may be supplied in decorator colors.

The media material 28 is preferably white so as visually to signal, by its being discolored, the time to replace it. When sufficiently dirty, it can be easily replaced by simply removing the filter frame from the window and disassembling the filter frame and replacing the filter material with a clean section of filter material. The filter frame can then be easily reassembled and reinserted within the window frame. The combination of a durable frame with a fitted and disposable replacement medium, enables users to purchase the frame for a window only once and purchase only less expensive, more compact replacement media when necessary.

The above-described embodiments have been described with respect to the use of two or more frame sections forming the frame unit. However, it will be understood that variations using fewer components are also possible. For example, as described above, the frame assembly can consist of a single frame member, such as frame section 12 shown in FIG. 1D, with media material 28 held to frame section 12 with rods 14, without departing from the scope of the invention.

In addition, the above-described embodiments use a section of filter material that can be predimensioned or cut-to-fit within the filter frame. However, it is within the scope of the present invention to provide the filter material on a roll. The roll may be attached to an edge or end of the filter frame such that the filter material can be pulled from the roll and drawn through the frame, as desired, by the end user in order to replace soiled filter material with fresh filter material. Under these circumstances the filter material is preferably perforated at predetermined positions so that the dirty portion of filter material can be easily ripped off and discarded.

The preferred embodiment reduces the frames retail height by about 50 percent for more efficient packaging, shipping, store display and consumer conveyance. Multipacks of flat media or media rolls may be used to enhance consumer value by reducing manufacturing and packaging costs and wasted media (with continuous roll).

The effectiveness of the above described filter frame system can be further enhanced by an optional cut-to-fit strip of filter material 66. As shown in FIGS. 6 and 6A, the material 66 may be attached to the top of the lower sash 64 with adhesive or Velcro—type tape. One edge 67 of the strip 66 is fringe cut to block or filter outdoor air that might otherwise enter through the open-window gap between the top of the lower sash 64 and the frame or window pane of the opposing or facing upper sash 68. The fringe minimizes gaps between the upper sash window pane and frame and the top of the lower sash.

The present invention reduces outdoor contamination of indoor air and reduces indoor air pollution by diluting the concentration and therefore the danger of indoor pollutants. While for purposes of illustration and explanation, several forms of this invention have been disclosed, other forms thereof may become apparent to those skilled in the art upon reference to this disclosure and, therefore, this invention is to be limited only by the scope of the appended claims.

What is claimed is:

1. A frame assembly comprising:

first and second frame units detachably assembled together, said first frame unit having a plurality of loop members extending therefrom and said second frame unit having a plurality of orifices corresponding to said plurality of loop members, said plurality of loop members extending through said plurality of orifices when said first and second frame units are assembled together;

an intervening media material between said first and second frame units and protruding beyond at least one peripheral edge of one of said frame units to define a perimeter flap; and at least one rod detachably interconnecting said frame units together and adapted to mount said frame units and media material over a desired opening, said perimeter flap adapted to fill and seal a space between said frame units and at least a portion of a periphery of the desired opening.

2. A frame assembly, as recited in claim 1, wherein said at least one rod is adapted to pass through the plurality of loop members when said first and second frame units are assembled together thereby to maintain said first and second frame units together and to mount said frame units within the desired opening.

3. The frame assembly of claim 2 in which said rod is releasably engageable with said loop members whereby the frame assembly may be disassembled for changing said intervening media.

4. A frame assembly, as recited in claim 1, wherein said intervening media material comprises a filter material for filtering air.

5. A frame assembly, as recited in claim 1, wherein said intervening media material comprises a screen material.

6. The frame assembly of claim 1 in which said intervening media material comprises a plurality of slits, each of said loop members extending through one of said slits when said first and second frame units are assembled together.

7. A frame assembly comprising:

a frame dimensioned to fit within a desired opening, the frame including first and second frame units detachably assembled together, the first frame unit including a plurality of projections to extend through corresponding openings provided within the second frame unit;

an intervening media material between said first and second frame units and extending beyond at least one outside peripheral edge of the frame; and at least one mounting member releasably engageable with said projections to hold said first and second frame units together.

8. The frame assembly of claim 7 comprising:

a plurality of mounting caps detachably mounted to the assembled frame units, the plurality of mounting caps for mounting the frame assembly within a window frame.

9. The frame assembly of claim 7 in which said intervening media comprises filter material, said material filling and sealing a space between the frame assembly and at least a portion of a periphery of the desired opening.

10. The frame assembly of claim 7 in which each of said projections comprises a loop traversing said intervening media material and a corresponding one of said openings in said second frame unit, said mounting member comprising a rod slidably insertable through said loops to hold said first and second frame units together.

11. The frame assembly of claim 7 in which said intervening media material is selected from one of a filter material and a screen material.

12. The frame assembly of claim 8 in which said media material has a slotted peripheral fringe portion protruding outwardly from predetermined peripheral sections of said frame to seal a space between said frame and at least a portion of a perimeter defining said selected opening.

* * * * *